US006980073B2

(12) United States Patent
Wada

(10) Patent No.: US 6,980,073 B2
(45) Date of Patent: Dec. 27, 2005

(54) IGNITION COIL WITH OPTIMIZED THERMAL STRESS RELAXING MEMBER

(75) Inventor: Junichi Wada, Aichi (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/765,176

(22) Filed: Jan. 28, 2004

(65) Prior Publication Data

US 2004/0183638 A1 Sep. 23, 2004

Related U.S. Application Data

(63) Continuation of application No. PCT/JP03/06940, filed on Jun. 2, 2003.

(30) Foreign Application Priority Data

Jun. 3, 2002 (JP) ..... 2002-161475

(51) Int. Cl.[7] ..... H01F 27/02
(52) U.S. Cl. ..... 336/90; 336/96
(58) Field of Search ..... 336/90–96, 107, 336/192, 198; 123/634–635

(56) References Cited

U.S. PATENT DOCUMENTS 6,191,674 B1 * 2/2001 Adachi et al. ..... 336/90
6,208,231 B1 * 3/2001 Oosuka et al. ..... 336/107
2002/0057170 A1 * 5/2002 Skinner et al. ..... 336/198
2002/0101315 A1 * 8/2002 Hamer et al. ..... 336/90
2003/0184424 A1 * 10/2003 Kondo et al. ..... 336/90

FOREIGN PATENT DOCUMENTS

| | | | |
|---|---|---|---|
| JP | 10-340822 | A | 12/1998 |
| JP | 11-111545 | | 4/1999 |
| JP | 11-144986 | A | 5/1999 |
| JP | 11-243023 | A | 9/1999 |
| JP | 2000-49024 | A | 2/2000 |
| JP | 2000-269056 | A | 9/2000 |
| JP | 2001-110657 | A | 4/2001 |
| JP | 2003-229319 | A | 8/2003 |

* cited by examiner

*Primary Examiner*—Tuyen T Nguyen
(74) *Attorney, Agent, or Firm*—Nixon & Vanderhye PC

(57) ABSTRACT

An ignition coil comprises a housing, a rod-shaped center core 54 arranged substantially at the center within the housing, a thermal stress relaxing member 52 covering the outer circumferential surface of the center core 54, a cylindrical spool 4 arranged on the outer circumferential side of the thermal relaxing member 52 with a gap 9 in between and a resin insulating material 8*a* with which the gap 9 is filled and which hardens. The thermal stress relaxing member 52 is wound around the center core 54 and the thickness of the thermal stress relaxing member 52 is set to a thickness so that the thermal stress, which is caused by the thermal deformation of the center core 54 and is applied to the resin insulating material 8*a*, is reduced and reaches a saturation value thereof.

7 Claims, 7 Drawing Sheets

IGNITION COIL WITH OPTIMIZED THERMAL STRESS RELAXING MEMBER

CROSS-REFERENCE TO RELATED APPLICATIONS

This application is based on, and claims the priority of, Japanese Patent Application Filing No. 2002-161475, filed on Jun. 3, 2002, the contents being incorporated therein by reference, and is a continuation of PCT/JP03/06940 filed Jun. 2, 2003.

BACKGROUND OF THE INVENTION

1. Field of the Invention

The present invention relates to an ignition coil. More particularly, the present invention relates to an ignition coil of a stick type mounted directly on an ignition plug hole of an engine.

2. Description of the Related Art

A sectional view in a direction perpendicular to the axis of an ignition coil 100 near a laminated core 101 of an ignition coil 100 is shown in FIG. 8. As shown schematically, the laminated core 101 is rod shaped. The laminated core 101 is made up of a plurality of strip-shaped thin silicon steel plates 102 stacked in the radial direction. Around the outer circumferential surface of the laminated core 101, a tape 103 made of poly ethylene terephthalate (PET) is wound. Outside the outer circumference of the tape 103, a cylindrical secondary spool 104 is arranged coaxially with the laminated core 101. A gap 105 is defined between the inner circumferential surface of the secondary spool 104 and the outer circumferential surface of the tape 103. A secondary coil 106 is wound around the outer circumferential surface of the secondary spool 104. Each member, described above, is contained in a housing (not shown), which is the outer shell of the ignition coil 100.

An epoxy resin is injected into the housing. The gap between the individual members in the housing is filled with the epoxy resin, which hardens therein. The epoxy resin ensures insulation between the individual members. Moreover, the epoxy resin fixes each member. The gap 105 also is filled with an epoxy resin 107*a*. FIG. 9 shows the sectional view taken along the line I—I in FIG. 8. As shown schematically, the gap between the secondary coil 106 and the outer circumferential surface of the secondary spool 104 also is filled with an epoxy resin 107*b*.

The linear expansion coefficients differ between the epoxy resin, the secondary coil 106 and the secondary spool 104. At a low temperature, the linear expansion coefficient of the secondary coil 106 is lower than that of the secondary spool 104 and that of the epoxy resin. Because of this, the secondary spool 104 and the epoxy resin 107*a* shown in FIG. 9 tend to contract and deform in the direction toward the center of the secondary spool 104, that is, in a state in which the radii thereof are reduced. In contrast to this, the secondary coil 106 hardly deforms. However, the secondary winding 106 and the secondary spool 104 are linked to each other via the epoxy resin 107*b* present in the gap. Therefore, even though the secondary spool 104 and the epoxy resin 107*a*, which tend to contract and deform in the direction toward the center of the secondary spool 104, that is, in a state in which the radii thereof are reduced, are prevented from doing so, by the secondary coil 106, from the outer circumferential side. In other words, a thermal stress is applied from the outer circumferential side to the members arranged within the inner circumferential side of the secondary coil 106. To be specific, thermal stress 109 acts in the circumferential direction as shown by the arrow in FIG. 8

On the other hand, the laminated core 101 is made up of the plurality of stacked silicon steel plates 102. Each of the stacked silicon steel plates 102 becomes warped and deformed by a small amount because of the thermal stress due to cooling load of an engine. Therefore, if the laminated core 101 is in contact with the epoxy resin 107*a* in a bare state, the laminated core 101 is deformed into an elliptic shape because of the warpage and deformation of the silicon steel plate 102, as shown exaggeratedly by a dotted line 110 in FIG. 8. Due to the elliptic deformation of the laminated core 101, a thermal stress 111 is applied to the epoxy resin 107*a* in the direction of the longitudinal axis of the ellipse, as shown by the arrow in FIG. 8. Because of the combined effect of the thermal stress 111 in the direction of the longitudinal axis of the ellipse and the thermal stress 109 in the circumferential direction, a large thermal stress is applied to the epoxy resin 107*a* as a result.

Moreover, if the laminated core 101 is in contact with the epoxy resin 107*a* in a bare state, there is the possibility that a crack may occur starting from a pointed corner portion 108 of the silicon steel plate 102 because of the thermal stress 109 in the circumferential direction.

If the laminated core 101 is arranged in a bare state, the above-mentioned problem occurs in the ignition coil 100. To prevent this, the laminated core 101 is wound with the tape 103 as described above. In other words, as the tape 103 binds the laminated core 101 from the outer circumferential side, the laminated core 101 is prevented from being deformed elliptically. Moreover, as the tape 103 covers the silicon steel plate 102, the pointed corner portion 108 is enclosed. In this manner, the tape 103 relaxes the thermal stress applied to the epoxy resin 107*a* interposed in the gap 105.

The thickness of the tape 103 is in proportion to the quantity of thermal stress relaxation required of the tape 103. To be specific, the greater the thickness of the tape 103, the more the elliptic deformation of the laminated core 101 is suppressed. Because of this, the quantity of thermal stress relaxation is increased. Moreover, the greater the thickness of the tape 103, the more unlikely that roughness due to the corner portion 108 appears on the outer circumferential side of the tape 103. Therefore, the corner portion 108 is more unlikely to become the starting point of a crack.

Conventionally, however, there was no information about optimization of the thickness of the tape 103, namely a thermal stress relaxing member. Therefore, the life span of the epoxy resin 107*a* varied between an ignition coil having the tape 103 with a great thickness and one having the tape 103 with a small thickness because of defects such as a crack caused by a thermal stress.

SUMMARY OF THE INVENTION

The ignition coil of the present invention has been completed with the above-mentioned problems being taken into account. Therefore, the object of the present invention is to provide an ignition coil equipped with a thermal stress relaxing member, the thickness of which is optimized.

(1)

In order to solve the above-mentioned problems, the ignition coil of the present invention comprises: a housing; a rod-shaped center core arranged substantially at the center in the housing; a thermal stress relaxing member covering the outer circumferential surface of the center core; a cylindrical spool arranged outside the outer circumference of the thermal stress relaxing member with a gap in between; and a resin insulating material with which the gap is filled and which hardens; wherein the thermal stress relaxing member is wound around the center core and the thickness of the thermal stress relaxing member is set to a thickness so that the thermal stress caused by the thermal deformation of the center core and applied to the resin insulating material is relaxed (reduced) and reaches a saturation value of the thermal stress which is explained below.

FIG. 1 is a graph conceptually showing the relationship between the thickness of a thermal stress relaxing member and the thermal stress applied to a resin insulating material. As shown schematically, when the thickness is small, the thickness is in proportion to the quantity of thermal stress relaxation. However, when the thickness exceeds a certain thickness T, the proportional relationship holds no longer. In other words, the quantity of thermal stress relaxation reaches a saturation value S. This is because, when the thickness of the thermal stress relaxing member reaches the thickness T, most of thermal deformation of the center core (the laminated core 101 in the aforementioned FIG. 8) is suppressed. Therefore, even if the thickness of the thermal stress relaxing member is increased to a thickness greater than the thickness T, the thermal deformation of the center core hardly changes, that is, the thermal deformation of the center core is hardly reduced (suppressed).

According to the ignition coil of the present invention, the thickness of the thermal stress relaxing member is set to a thickness so that the thermal stress can be relaxed until the saturation value S is reached. Therefore, the thermal stress to be applied to the resin insulating material present in the gap defined between the outer circumferential surface of the thermal stress relaxing member and the inner circumferential surface of the spool (referred to simply as a gap hereinafter, when proper) is substantially only the thermal stress 109 in the circumferential direction shown in the aforementioned FIG. 8. In other words, the thermal stress to be applied to the resin insulating material in the gap becomes substantially constant among a plurality of ignition coils. Because of this, it is possible to prevent the life span, of the resin insulating material in the gap, from varying among the plurality of ignition coils. In addition, it is possible to prevent the life span of the ignition coil from varying among the plurality of ignition coils. As a result, the product management of the ignition coil is facilitated.

The saturation value S is, in other words, the maximum value of the quantity by which the thermal stress can be relaxed by the thermal stress relaxing member. Therefore, according to the ignition coil of the present invention, the absolute value of the thermal stress to be applied to the resin insulating material in the gap becomes relatively small. As a result, the life span of the resin insulating material in the gap is lengthened. In addition, the life span of the ignition coil is lengthened accordingly.

It is preferable to set the thickness of an ignition coil to the thickness T. It is then possible to reduce the amount of thermal stress relaxing member to be used while ensuring an equivalent quantity of thermal stress relaxation compared to the case where the thickness is set to one greater than the thickness T. As a result, the cost required for the thermal stress relaxing member and even the manufacturing cost of the ignition coil can be reduced. Moreover, it is possible to reduce the outer circumferential diameter of the ignition coil.

In the present invention, the term "thickness of a thermal stress relaxing member" means the thickness of the entire thermal stress relaxing member in the radial direction. For example, when the thermal stress relaxing member is made of a single-layered tape, the thickness of the tape itself corresponds to the thickness of the thermal stress relaxing member. When the thermal stress relaxing member is made of, for example, a four-layered tape, the thickness of the four layers of the tape corresponds to the thickness of the thermal stress relaxing member.

Moreover, the term "winding" in the present invention includes a case where a thermal stress relaxing member on which a shape after winding is conferred in advance is arranged on the center core, as well as a case where a thermal stress relaxing member is wound directly around the center core.

(2)

It is preferable that the center core has a structure of a laminated core in which magnetic plates are stacked in the radial direction. When the laminated core is used as the center core, the laminated core 101 is thermally deformed into an elliptic shape, as shown in the aforementioned FIG. 8. Because of this, in an ignition coil having a laminated core in particular, the thermal stress to be applied to the resin insulating material in the gap increases. Therefore, it is likely that the life span of the resin insulating material in the gap in the ignition coil having the laminated core varies considerably.

Regarding this point, if the thickness of the thermal stress relaxing member is set to a thickness so that the thermal stress can be relaxed until the saturation value is reached, as in the present structure, it is possible to reduce the variations in life span of the resin insulating material.

Moreover, in the ignition coil having the laminated core, as described above, the thermal stress applied to the resin insulating material by the laminated core is essentially great. Therefore, according to the present structure, it is possible to effectively reduce the great thermal stress. In other words, the quantity of thermal stress relaxation shown in the aforementioned FIG. 1 is increased. As described so far, the ignition coil of the present invention is particularly suitable for an embodiment of the ignition coil having a laminated core.

(3)

The above-mentioned thermal stress relaxing member is preferably made of a material having a linear expansion coefficient of $25\times10^{-6}/°$ C. or lower, such as poly ethylene terephthalate, polyester, glass fabrics, polyamide, fluororesin or vinyl chloride, and the thickness of the thermal stress relaxing member is preferably set to 0.1 mm or greater (excluding adhesive).

In other words, in this structure of the present invention, the thermal stress relaxing member is formed of PET, etc. Moreover, the thickness of the thermal stress relaxing member is set to 0.1 mm or greater. The thermal stress relaxing member is formed of PET, etc., because PET has a relatively low linear expansion coefficient of $25\times10^{-6}/°$ C. or lower. When the linear expansion coefficient is low, the quantity of thermal deformation due to the cooling load of an engine is small. Because of this, according to the present invention, it is possible to effectively reduce the thermal deformation of the center core. In other words, it is possible to effectively relax the thermal stress to be applied from the center core to the resin insulating material in the gap.

The thickness of the thermal stress relaxing member is set to 0.1 mm or greater because if it is less than 0.1 mm, the quantity of thermal stress relaxation does not reach the saturation value. In other words, a thickness of 0.1 mm corresponds to the thickness T shown in the aforementioned FIG. 1. Therefore, according to the present structure of the present invention, it is possible to ensure the saturation value S, which is the maximum value of the quantity of thermal stress relaxation.

The present invention may be more fully understood from the description of the preferred embodiments of the invention set forth below, together with the accompanying drawings.

DESCRIPTION OF THE PREFERRED EMBODIMENTS

The embodiments of the ignition coil according to the present invention are explained below.

(1)

First Embodiment

Figure 1:
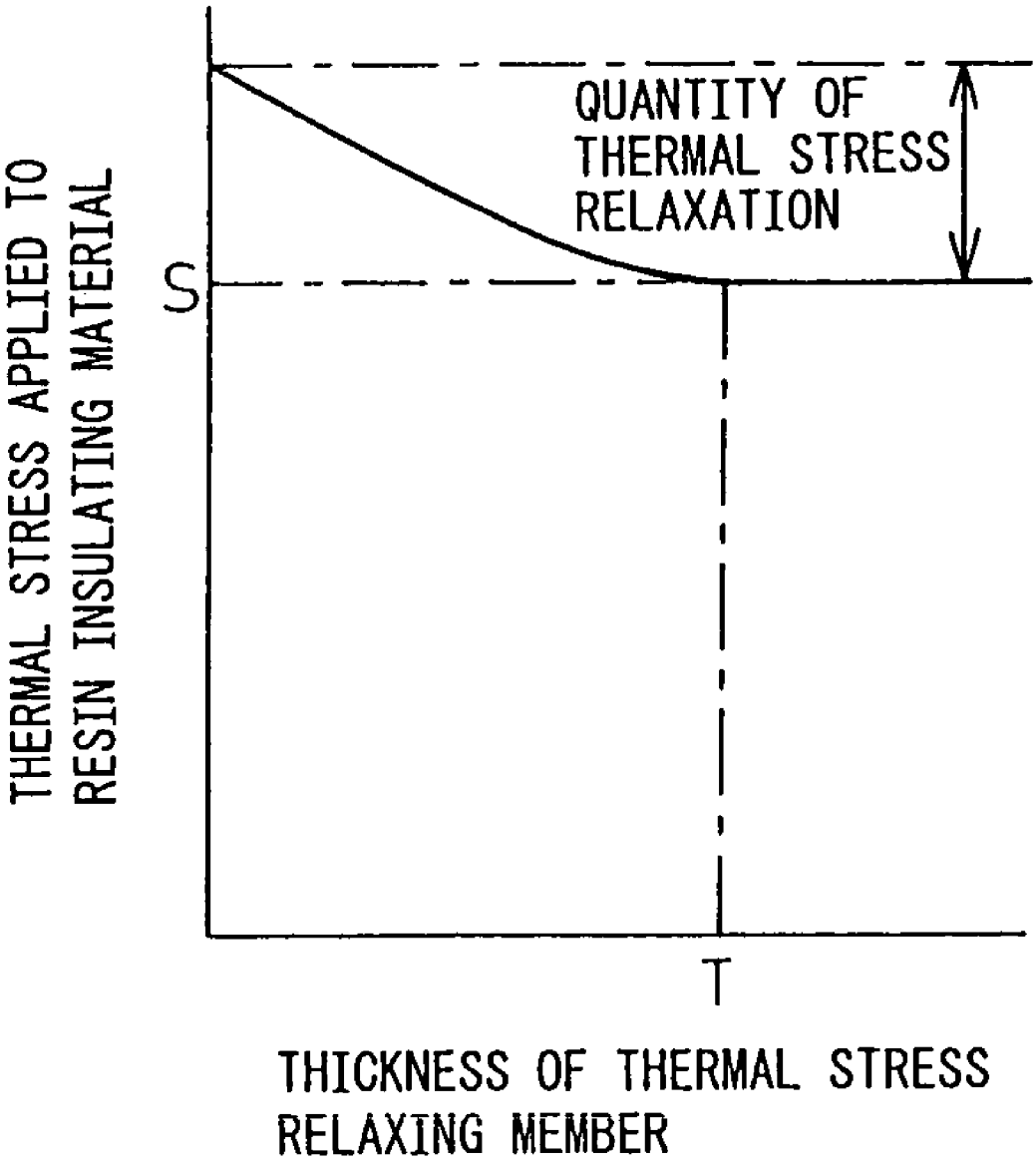
FIG. 1 is a graph showing a relationship between the thickness of a thermal stress relaxing member and a thermal stress to be applied to a resin insulating material.
Figure 2:
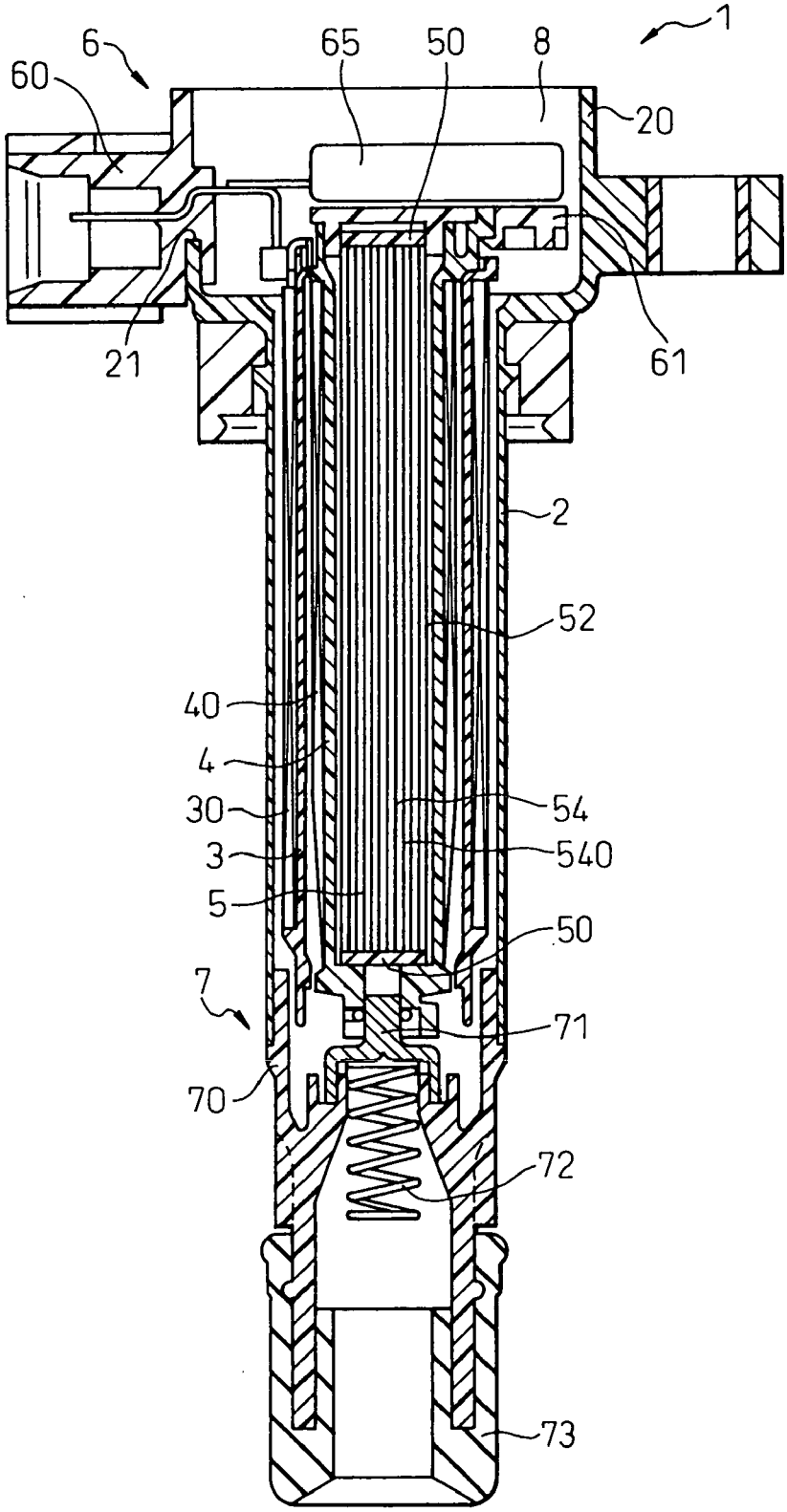
FIG. 2 is a sectional view of an ignition coil in the axial direction thereof in a first embodiment of the present invention.
Figure 3:
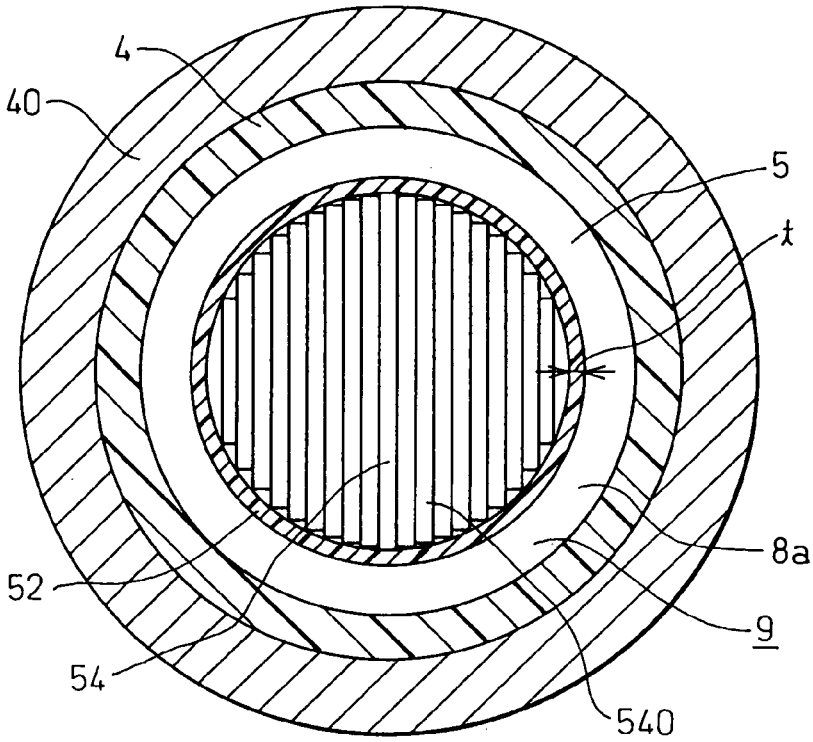
FIG. 3 is a sectional view in the vicinity of a center core of the ignition coil in the direction perpendicular to the axial direction thereof in the first embodiment.

First, the structure of the ignition coil in the present embodiment is explained below. FIG. 2 shows a sectional view of the ignition coil in the axial direction in the present embodiment. FIG. 3 shows a sectional view in the vicinity of the center core of the ignition coil in the direction perpendicular to the axial direction thereof in the present embodiment.

An ignition coil 1 is contained in a plug hole (not shown) formed in each cylinder at the upper portion of an engine block. On the other hand, the ignition coil 1 is connected to an ignition plug (not shown) at the lower portion in the figure, as will be described later.

As shown in FIG. 2, the ignition coil 1 comprises a housing 2. The housing 2 is made of resin and has a stepped-cylindrical shape whose diameter is enlarged toward the upper side. At the top end portion of the housing 2, where the diameter is enlarged, a wide opening portion 20 is formed. In a part of the side wall of the wide opening portion 20, a cutout window 21 is formed.

Within the housing 2, a center core 5, a primary spool 3, a primary coil 30, a secondary spool 4, a secondary coil 40, a connector 6 and an igniter 65 are contained.

Among them, the center core 5 comprises a laminated core 54, elastic members 50 and a tape 52. As shown in FIG. 3, the laminated core 54 is formed of a large number of strip-shaped silicon steel plates 540 having different widths and stacked in the radial direction. The silicon steel plate 540 is included in the magnetic plate materials of the present invention. As shown in FIG. 2, the laminated core 54 has a rod-like shape. The elastic member 50 is made of silicon rubber and has a cylindrical shape. The elastic members 50 are arranged at the top and bottom ends of the laminated core 54, that is, two of the elastic members 50 are arranged in total. As shown in FIG. 3, the tape 52 is made of PET, polyester, glass fabrics, polyamide, fluororesin, or vinyl chloride, and is wound around the outer circumferential surface of the laminated core 54. The tape 52 is included in the thermal stress relaxing member of the present invention. The tape 52 will be explained, in detail, later.

As shown in FIG. 2, the secondary spool 4 is made of resin and has a bottomed cylindrical shape. The secondary spool 4 is included in the spool of the present invention. The secondary spool 4 is arranged coaxially with the center core 5 and, at the same time, next to the outer circumferential side of the center core 5. As shown in FIG. 3, a cylindrical gap 9 is defined between the tape 52 and the secondary spool 4. The secondary coil 40 is wound around the outer circumferential surface of the secondary spool 4.

As shown in FIG. 2, the primary spool 3 is arranged coaxially with the secondary spool 4 and at the same time next to the outer circumferential side of the secondary spool 4. The primary spool 3 is made of resin and has a cylindrical shape. The primary coil 30 is wound around the outer circumferential side of the primary spool 3. On the outer circumferential side of the primary coil 30, an outer circumferential core (not shown) is arranged. The outer circumferential core is formed by rounding a rectangular silicon steel plate. In other words, the outer circumferential core has a cylindrical shape having a slit in the axial direction thereof.

An epoxy resin 8 is interposed between the above-mentioned members arranged within the housing 2. The epoxy resin 8 penetrates into the space between the above-mentioned members, and is hardened therein, by injecting an epoxy polymer and a hardening agent into the housing 2 evacuated to a vacuum through the wide opening portion 20.

The connector 6 is arranged in the wide opening portion 20 of the housing 2. The connector 6 comprises a square pipe portion 60 and a pedestal portion 61. The square pipe portion 60 is arranged so as to extrude from the cutout window 21 to the outside of the housing 2. The pedestal portion 61 is plate-shaped and arranged substantially at the center in the wide opening 20. The igniter 65 comprises power transistors, electric circuits and the like covered with the mold resin. The igniter 65 is mounted on the top end surface of the pedestal portion 61.

A high-voltage tower section 7 is arranged below the housing 2. The high-voltage tower section 7 comprises a tower housing 70, a high-voltage terminal 71, a spring 72 and a plug cap 73. The tower housing 70 is made of resin and has a cylindrical shape. The high-voltage terminal 71 is arranged at the upper side of the inner circumferential side of the tower housing 70. The high-voltage terminal 71 is made of metal and has a cup-like shape opening downward. The high-voltage terminal 71 is electrically connected to the secondary coil 40. The spring 72 is made of metal and has a spiral shape. The top end of the spring 72 is fixedly attached to the under surface of the upper base wall of the high-voltage terminal 71. The spring 72 is in elastic contact with the ignition plug (not shown). The plug cap 73 is made of rubber and has a cylindrical shape. The plug cap 73 is annularly attached to the bottom end portion of the tower housing 70. The ignition plug is pressed into the inner circumferential side of the plug cap 73.

Next, the action of the energized ignition coil in the present embodiment is explained below. First, the control signal from an engine control unit is transmitted to the primary coil 30 via the connector 6 and the igniter 65 shown in FIG. 2. Subsequently, a voltage is produced across the primary coil 30 by the effect of the self induction caused by the control signal. Then, the voltage is raised by the effect of the mutual induction between the primary coil 30 and the secondary coil 40. As a result, a high voltage is produced across the secondary coil 40. After this, the high voltage produced across the secondary coil 40 is transmitted to the ignition plug via the high-voltage terminal 71 and the spring 72. Finally, a spark is generated, at the cap of the ignition plug, by the transmitted high voltage.

Next, the tape of the ignition coil in the present embodiment is explained below. The tape 52 shown in FIG. 3 is made of PET and is shaped as a thin film. The tape 52 is wound around the outer circumferential surface of the laminated core 54 in four layers in total. The thickness of the tape 52, that is, the total thickness of the four layers is set to 0.1 mm (thickness t) based on the result of FEM analysis, which will be described later.

Figure 4:
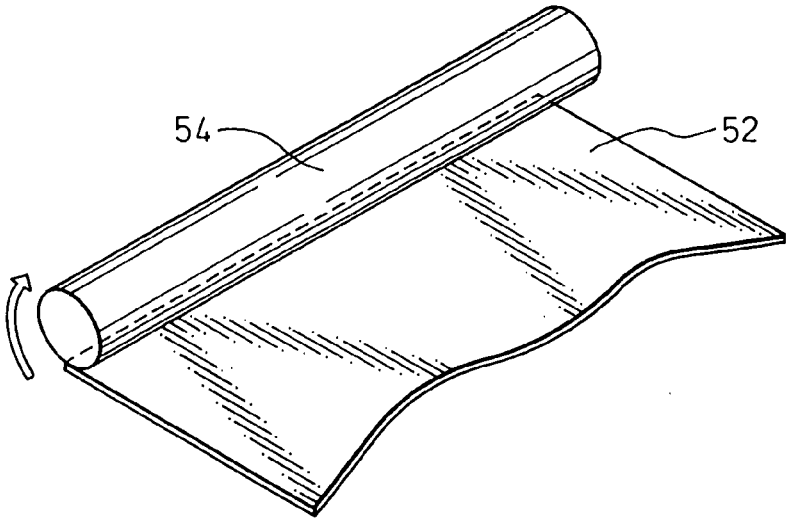
FIG. 4 is a diagram showing the winding method of a tape at the time of installation of the ignition coil in the first embodiment.

Next, the winding method of the tape 52 around the laminated core 54 is explained below. FIG. 4 shows a winding method of the tape at the time of installation of the ignition coil in the present embodiment. The silicon steel plates are not shown here. As shown schematically, the axial length of the tape 52 is set to a length substantially equal to the axial length of the laminated core 54. The thickness of a sheet of the tape 52 is 0.025 mm. As described above, the tape 52 is wound around the outer circumferential surface of the laminated core 54 to provide four layers in total.

Next, the result of the FEM analysis of the tape thickness of the ignition coil in the present embodiment is explained below. Design Space (product of CYBERNET SYSTEMS Co., Ltd.) is used for the operation of the FEM analysis.

Figure 5:
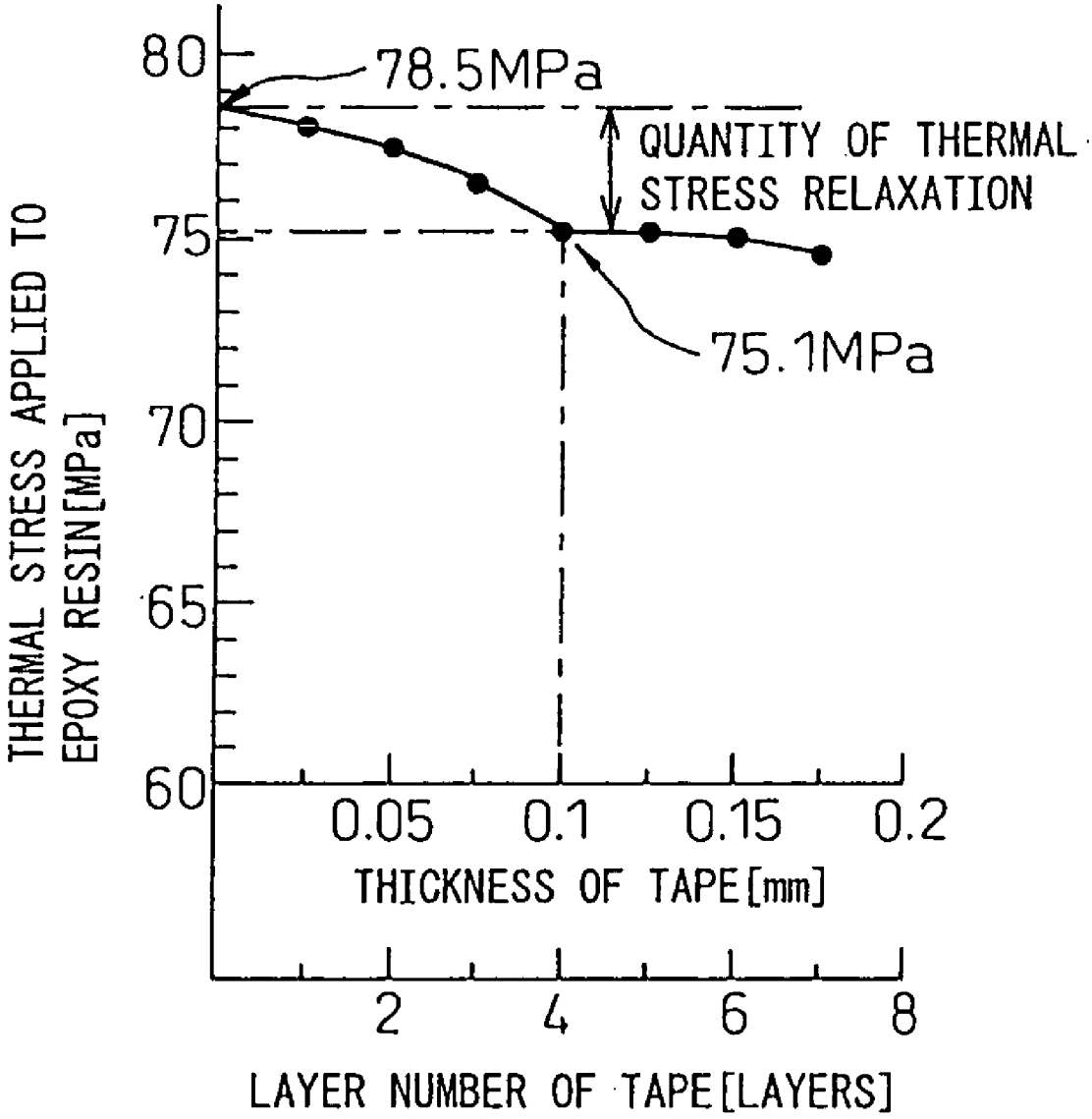
FIG. 5 is a graph showing relationships between the thickness of a tape obtained by the FEM analysis and the thermal stress to be applied to an epoxy resin, and between the number of layers of the tape and the thermal stress to be applied to the epoxy resin.

FIG. 5 is a graph showing the relationships between the thermal stress to be applied to an epoxy resin 8*a* in the gap 9 shown in FIG. 3 and the thickness of the tape and the number of layers of the tape which are obtained by the analysis (see FIG. 5). As shown schematically, when the thickness is less than 0.1 mm (the number of layers is four), the thermal stress decreases proportionally with greater thicknesses. On the other hand, when the thickness is equal to or greater than 0.1 mm, the thermal stress hardly decreases with greater thicknesses.

According to the FEM analysis, it was found that the quantity of thermal stress relaxation reached a state of saturation when the thickness was 0.1 mm. Moreover, it was found that the thermal stress of the epoxy resin at this time, that is, the saturation value of the quantity of thermal stress relaxation, was 75.1 MPa (the thickness of the epoxy was 0.4 mm). On the other hand, it was found that the quantity of thermal stress relaxation was 3.4 MPa. This value is obtained from the difference between the thermal stress 78.5 MPa of the epoxy resin when the thickness is 0 mm, which is obtained by extending the extrapolation line (denoted by the dotted line in the figure), and the saturation value 75.1 MPa. Based on the result of the FEM analysis, the thickness t of the tape 52 shown in FIG. 3 is set to t=0.1 mm, under the condition that the linear expansion coefficient is $25\times10^{-6}/°$ C. or lower and a Young's modulus is 6,000 MPa or less.

Figure 8:
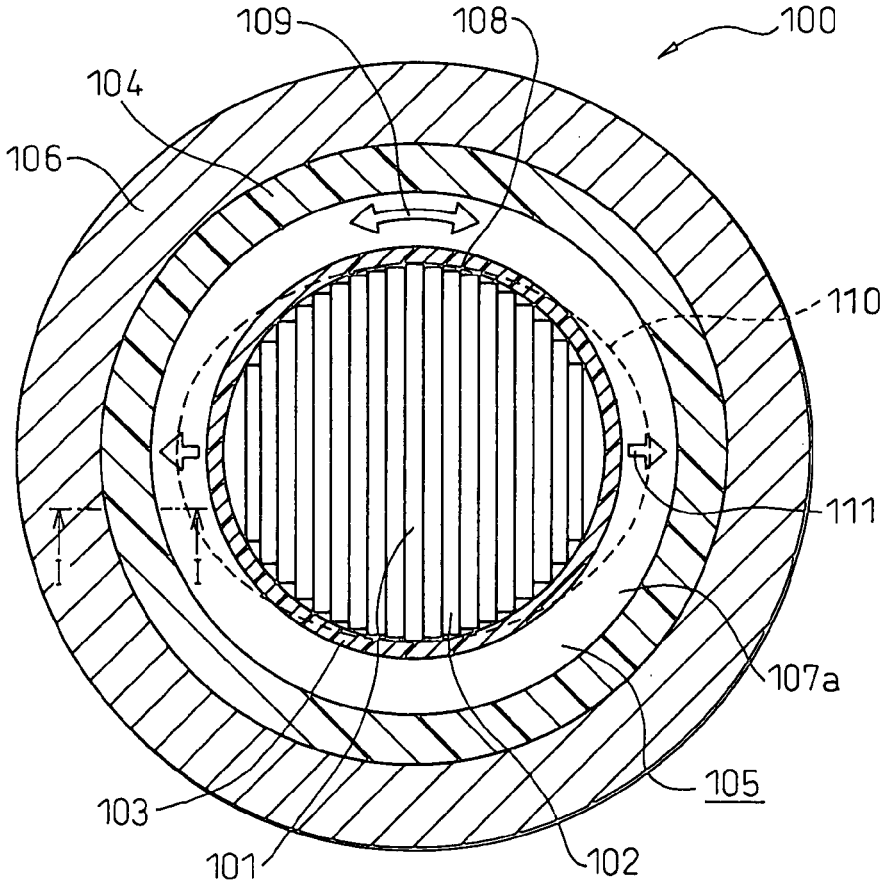
FIG. 8 is a sectional view in the vicinity of a laminated core of an ignition coil in the direction perpendicular to the axial direction thereof.
Figure 9:
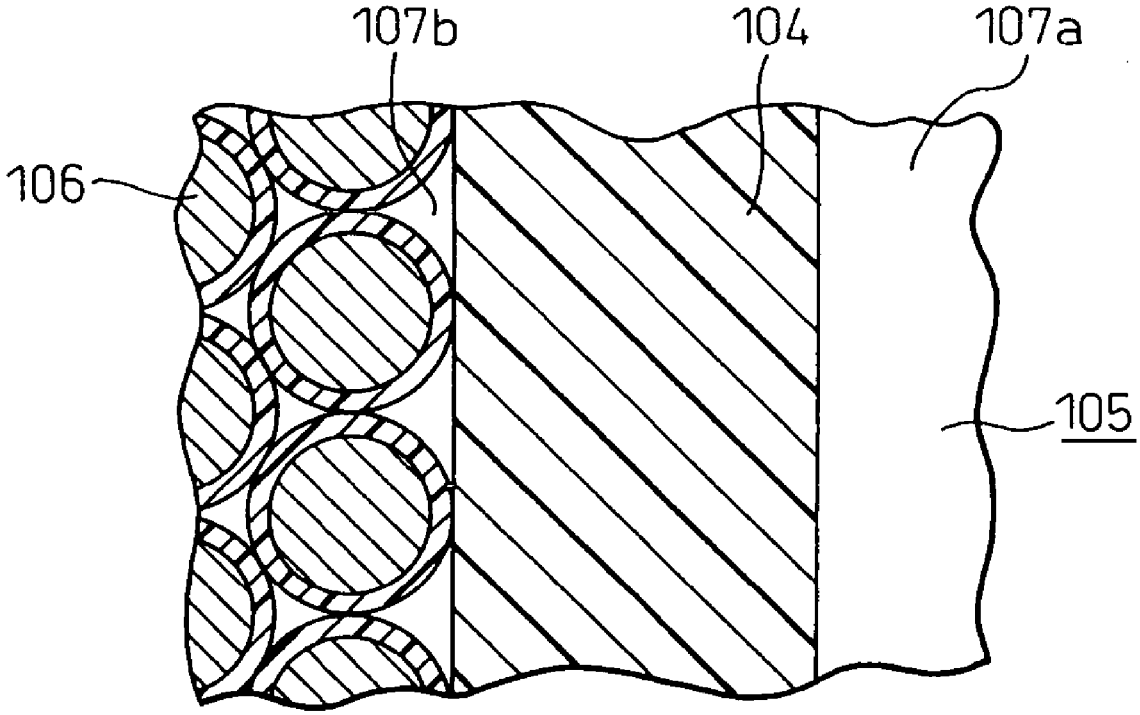
FIG. 9 is a sectional view taken along the I—I line in FIG. 8.

Next, the effect of the ignition coil in the present embodiment is explained below. According to the ignition coil 1 in the present embodiment, the thermal stress to be applied to the epoxy resin 8*a* is substantially only the thermal stress 109 in the circumferential direction shown in the aforementioned FIG. 8. In other words, the thermal stress to be applied to the epoxy resin 8*a* is substantially constant among the plurality of the ignition coils 1. Because of this, it is possible to prevent the life span of the epoxy resin 8*a* from varying among a plurality of the ignition coils 1. Moreover, it is also possible to prevent the life span of the ignition coil 1 from varying among a plurality of the ignition coils 1. As a result, the product management of the ignition coil 1 is facilitated.

The saturation value 75.1 MPa is, in other words, the maximum value of the quantity by which the thermal stress can be relaxed by the tape 52. Because of this, according to the ignition coil 1 in the present embodiment, the absolute value of the thermal stress to be applied to the epoxy resin 8*a* becomes relatively small. As a result, the life span of the epoxy resin 8*a* is lengthened. In addition, the life span of the ignition coil 1 is lengthened accordingly.

According to the ignition coil 1 in the present embodiment, it is possible to ensure an equivalent quantity of thermal stress relaxation even though the thickness of the tape 52 is two thirds the thickness in the case where the thickness of the tape 52 is set to, for example, 0.15 mm, as shown in FIG. 5. In other words, it is possible to reduce the necessary quantity of the tape 52 to be used while ensuring an equivalent quantity of thermal stress relaxation compared to a case where the thickness of the tape 52 is set greater than 0.1 mm. Because of this, the cost of the tape 52 and the manufacturing cost of the ignition coil 1 can be reduced. Moreover, it is possible to reduce the outer circumferential diameter of the ignition coil 1.

(2)

Second Embodiment

The present embodiment differs from the first embodiment only in the tape winding method. Therefore, only the difference is explained here.

Figure 6:
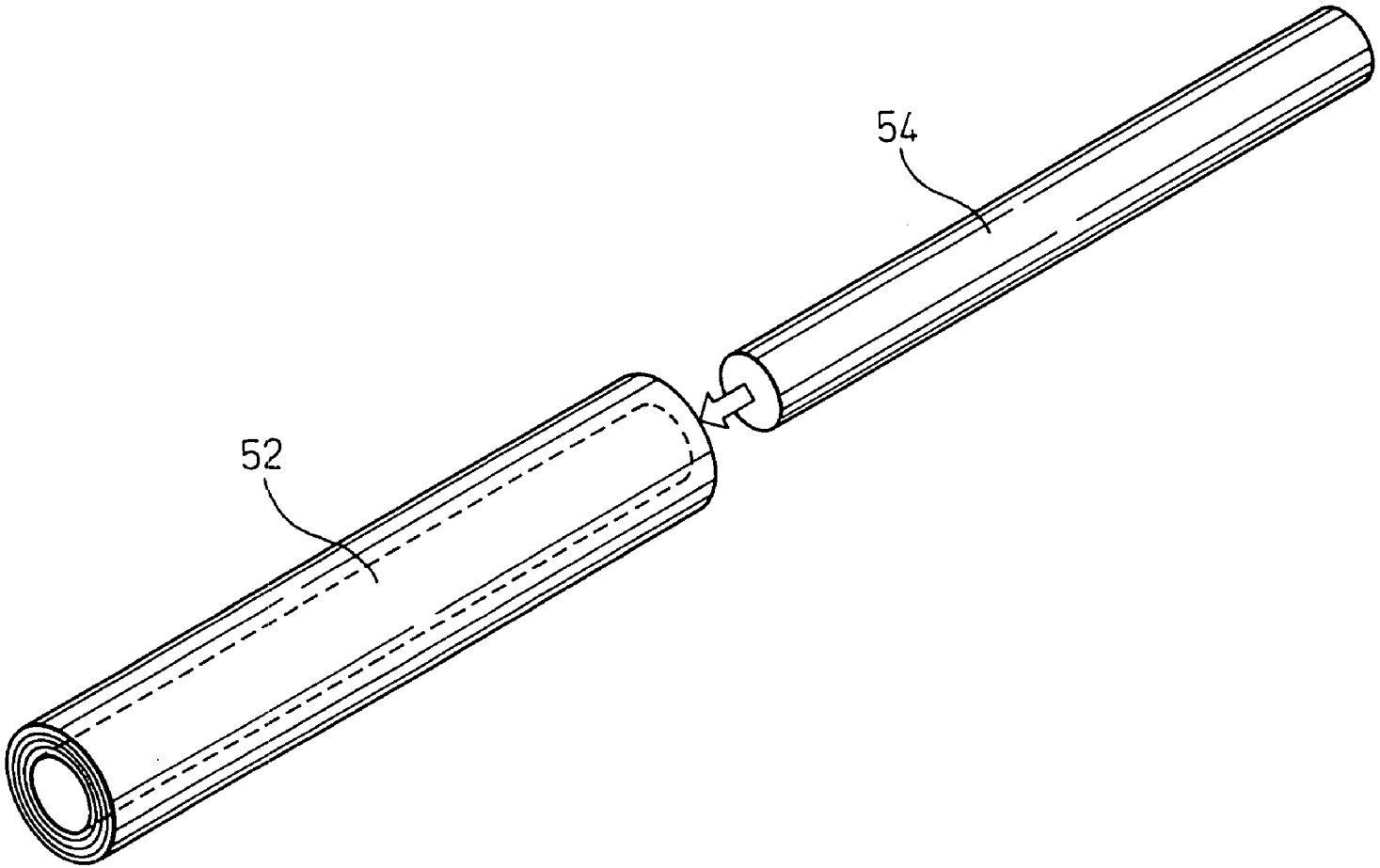
FIG. 6 is a diagram showing the winding method of a tape at the time of installation of an ignition coil in a second embodiment of the present invention.

FIG. 6 shows a tape winding method at the time of installation of the ignition coil in the present embodiment. The same symbols are used for portions corresponding to those in FIG. 4. As shown schematically, the tape 52 already has a shape after winding, that is, a cylindrical shape with four wound layers, before it is arranged around the outer circumferential surface of the laminated core 54. As shown by the arrow in the figure, the tape 52 is arranged around the outer circumferential surface of the laminated core 54 by inserting the laminated core 54 into the inner circumferential side of the cylindrical tape 52.

As in the present embodiment, the case where the tape 52, which is shaped in advance, is arranged around the outer circumferential surface of the laminated core 54, instead of directly winding the tape 52 around the outer circumferential surface of the laminated core 54, is also included in the "winding" of the present invention. According to the present embodiment, it is possible to arrange the tape 52 around the laminated core 54 just by inserting the laminated core 54 into the inner circumferential side of the tape 52. Because of this, the winding work of the tape 52 is made easier.

(3)

Third Embodiment

The present embodiment differs from the first embodiment only in the axial length of the tape. Therefore, only the difference is explained here.

Figure 7:
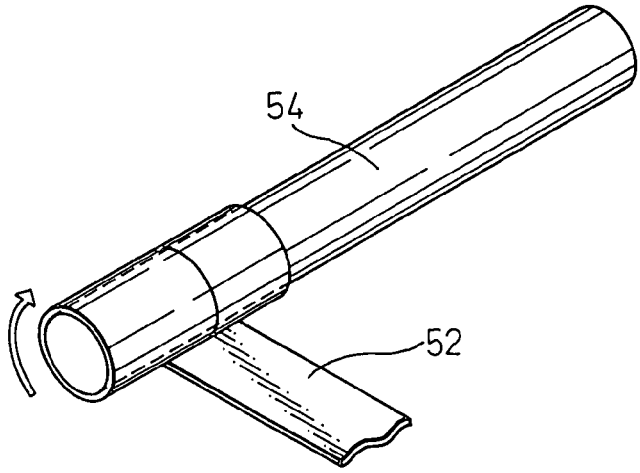
FIG. 7 is a diagram showing the winding method of a tape at the time of installation of an ignition coil in a third embodiment of the present invention.

FIG. 7 shows a tape winding method at the time of installation of the ignition coil in the present embodiment. The same symbols are used for portions corresponding to those in FIG. 4. As shown schematically, the axial length of the tape 52 is shorter than the axial length of the laminated core 54. In other words, the tape 52 has a narrow width. The tape 52 is wound around the outer circumferential surface of the laminated core 54 spirally. According to the present embodiment, it is possible to freely adjust the number of layers, that is, the thickness of the tape 52, along the axial direction of the outer circumferential surface of the laminated core 54.

(4)

Other Embodiments

The embodiments of the ignition coil of the present invention are described above. However, the embodiments are not limited to those described above. A person skilled in the art can device various modifications and improvements of those embodiments.

For example, although the secondary spool 4 is arranged at the inner circumferential side and the primary spool 3 at the outer circumferential side in the above embodiment, this arrangement can be reversed. In this case, the primary spool corresponds to the "spool" of the present invention.

Moreover, the number of layers of the tape 52 and the thickness of a layer are not limited particularly. All that is required is that the thickness of all of the layers of the tape 52 be set to a thickness (0.1 mm or greater in the embodiments described above) which can relax the thermal stress to be applied to the epoxy resin 8 to the saturation value. In addition, the material making up the tape 52 is not particularly limited to those described above as long as the material has a linear expansion coefficient of $25\times10^{-6}/°$ C., or lower, which can suppress the thermal deformation of the laminated core 54. Although the laminated core 54 made up of a large number of silicon steel plates 540 is used as a center core in the embodiments described above, a columnar integrated magnetic material may be used as a center core. Moreover, hexagonal-prism-shaped magnetic wires bundled into a columnar shape may be used as a center core.

Possibility of Industrial Utilization

According to the present invention, an ignition coil comprises a thermal stress relaxing member the thickness and the thermal expansion coefficient of which are optimized and can reduce the deformation of a stacked center core.

While the invention has been described by reference to specific embodiments chosen for the purposes of illustration, it should be apparent that numerous modifications could be made thereto by those skilled in the art without departing from the basic concept and scope of the invention.

What is claimed is:

1. An ignition coil comprising;

a housing;

a rod-shaped center core arranged substantially at the center within the housing;

a thermal stress relaxing member covering the outer circumferential surface of the center core;

a cylindrical spool arranged on the outer circumferential side of the thermal stress relaxing member with a gap therebetween; and a resin insulating material with which the gap is filled and which hardens and provides an electrical insulation between the center core and a coil wound around the cylindrical spool; wherein the thermal stress relaxing member is wound around the center core; and the thickness of the thermal stress relaxing member is set to a thickness so that the thermal stress, which is caused by the thermal deformation of the center core and is applied to the resin insulating material, is reduced and reaches a saturation value thereof.

2. An ignition coil, as set forth in claim 1, wherein the center core is a laminated core made up of magnetic plates stacked in the radial direction.

3. An ignition coil, as set forth in claim 1, wherein the thermal stress relaxing member has a linear expansion coefficient of $25\times10^{-6}°$ C. or lower and the thickness thereof is set to 0.1 mm or greater.

4. An ignition coil, as set forth in claim 1, wherein the thermal stress relaxing member is made of poly ethylene terephthalate, polyester, glass fabrics, polyamide, fluororesin or vinyl chloride and the thickness of the thermal stress relaxing member is set to 0.1 mm or greater.

5. An ignition coil, as set forth in claim 1, wherein the thermal stress relaxing member is provided to cover and contain an entire outer side surface of the center core.

6. An ignition coil, as set forth in claim 1, further comprising a second cylindrical spool arranged on the outer circumferential side of the coil wound around the first said cylindrical spool, and a second coil wound around the second cylindrical spool.

7. An ignition coil, as set forth in claim 1, wherein said cylindrical spool defines a secondary spool on which a secondary coil is wound and further comprising a primary spool arranged on the outer circumferential side of the secondary coil and a primary coil wound around an outer circumferential side of the primary spool.

* * * * *